United States Patent [19]

Reese

[11] 4,206,794

[45] Jun. 10, 1980

[54] RATCHET DRIVER

[76] Inventor: William C. Reese, R.D. #1, Box 396 B, Newville, Pa. 17241

[21] Appl. No.: 950,439

[22] Filed: Nov. 6, 1978

[51] Int. Cl.[2] ..... B25G 1/00

[52] U.S. Cl. ..... 145/75; 145/61 L; 145/71; 145/72

[58] Field of Search ..... 145/61 L, 75, 71, 72, 145/73, 74, 77, 50 R; 81/58.1

[56] References Cited

U.S. PATENT DOCUMENTS

| | | | |
|---|---|---|---|
| Re. 13,205 | 2/1911 | Lane | 145/71 |
| 183,235 | 10/1876 | Vassar | 145/72 UX |
| 536,116 | 3/1895 | Worthington et al. | 145/71 |
| 613,759 | 11/1898 | Cooper | 145/71 |
| 2,271,887 | 2/1942 | Kalbeck | 145/75 |
| 2,513,509 | 7/1950 | Morts | 145/50 R |
| 2,531,722 | 11/1950 | Brubeck | 145/72 |
| 3,475,999 | 11/1969 | Roberts et al. | 145/71 |
| 3,957,096 | 5/1976 | Rodman | 145/61 L |

FOREIGN PATENT DOCUMENTS

| | | | |
|---|---|---|---|
| 693342 | 8/1930 | France | 145/71 |
| 9766 | of 1908 | United Kingdom | 145/75 |

*Primary Examiner*—Othell M. Simpson
*Assistant Examiner*—J. T. Zatarga
*Attorney, Agent, or Firm*—Buell, Blenko & Ziesenheim

[57] ABSTRACT

A ratcheting screwdriver is provided having an integral handle, shank and blade with a receiver body intermediate the handle and blade removably receiving a ratchet drive handle.

3 Claims, 6 Drawing Figures

Fig. 4.
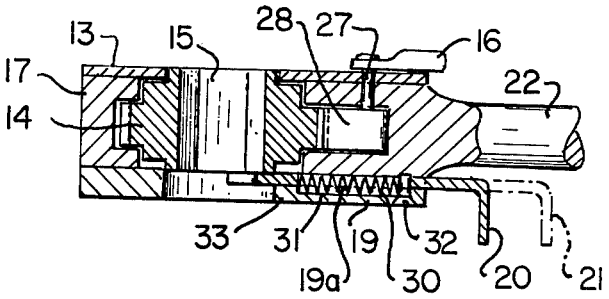
Fig. 3.
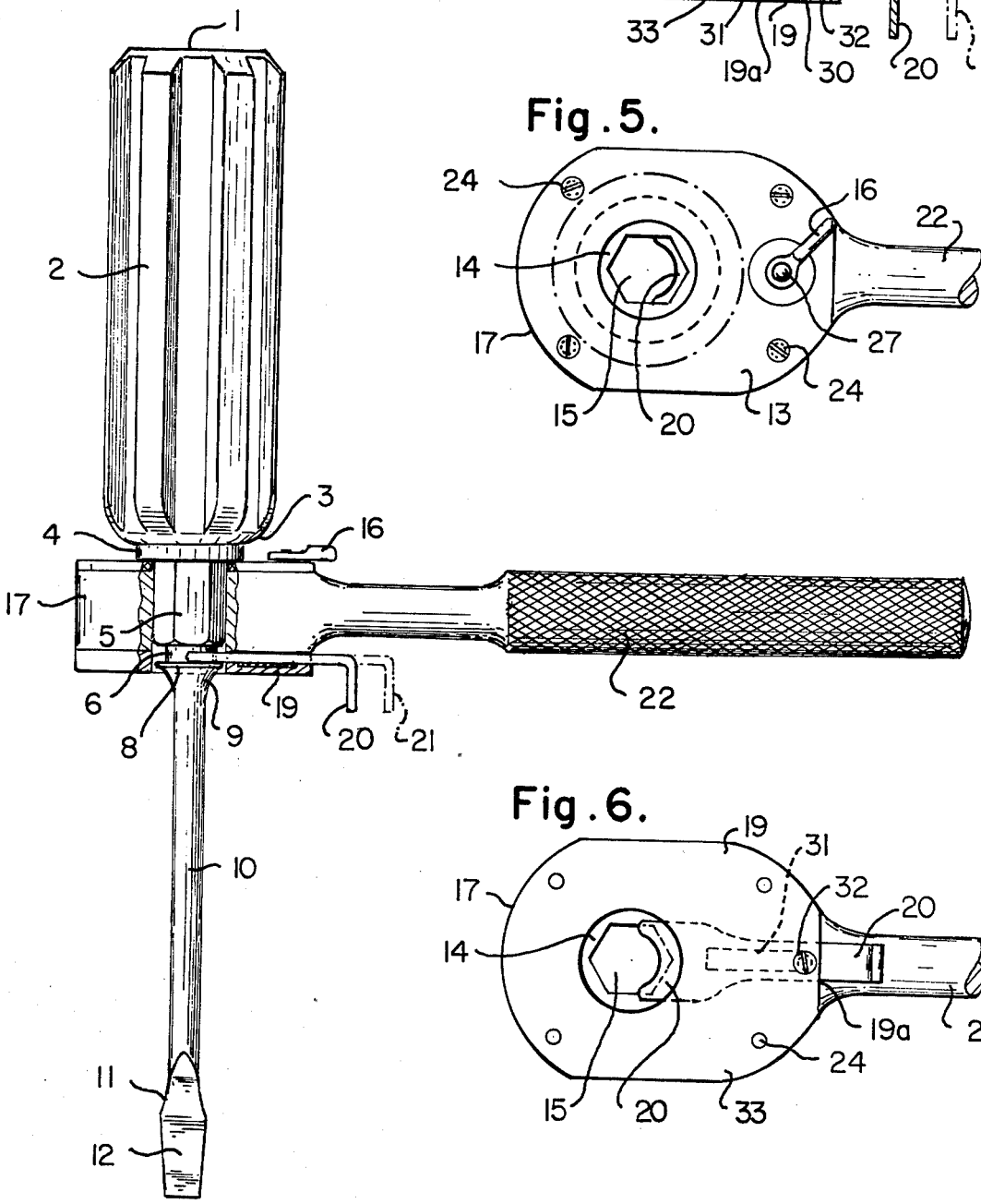
Fig. 5.
Fig. 6.

RATCHET DRIVER

This invention relates to ratchet drivers and particularly to ratcheting screw and nut drivers having an integral handle, shank and blade with a receiver body intermediate the handle and blade removably receiving a ratchet drive handle.

The invention is related basically to a convenient and improved instrument for transferring torsional or twisting force for rotatable hand tools such as screwdrivers, nut drivers and the like by means of a detachable female ratchet wrench. The invention will be hereafter described in terms of a screwdriver and the term screwdriver shall hereafter include the equivalent nut driver and the like. The improved torque amplification is obtained by means of a small detachable ratchet which includes a spring loaded retaining clip controlled by a trigger on the ratchet.

The power transfer in a conventional screwdriver from the operators hand to the driver blade is awkward and inefficient in that the torque force is applied through a very small diameter radius of the handle.

The present invention overcomes the problem of transferring the maximum torque from the operators hand to the screwdriver blade by means of a quick detachable ratchet handle without detracting from the independent capability of the screwdriver when not used in conjunction with the ratchet.

It is an object of this invention to provide a practical, simple, flexible tool having great mechanical advantage over prior like tools.

An object of the invention is to provide the torque amplification often needed in screwdrivers.

A further object is to provide this torque amplification in screwdrivers by means of a readily removable ratchet handle which can be added and removed without detracting from the ability to use the screwdriver in conventional fashion.

It is a further object of the invention to provide a ratchet driven screwdriver in which the ratchet handle and drive can be interchanged among many different screwdrivers.

In the foregoing general description of this invention, I have set out certain objects, purposes and advantages of my invention. Other objects, purposes and advantages of this invention will be apparent from the following description and accompanying drawings in which:

FIG. 3 is a side elevational view, partly in section showing the ratchet handle of FIG. 2 attached to the screwdriver of FIG. 1 in operative relationship;

FIG. 4 is a vertical section through the ratchet head of FIG. 2;

FIG. 5 is a top plan view of the ratchet head of FIGS. 2 through 4; and

FIG. 6 is a bottom plan view of the ratchet head of FIGS. 2 through 4.

Figure 1:
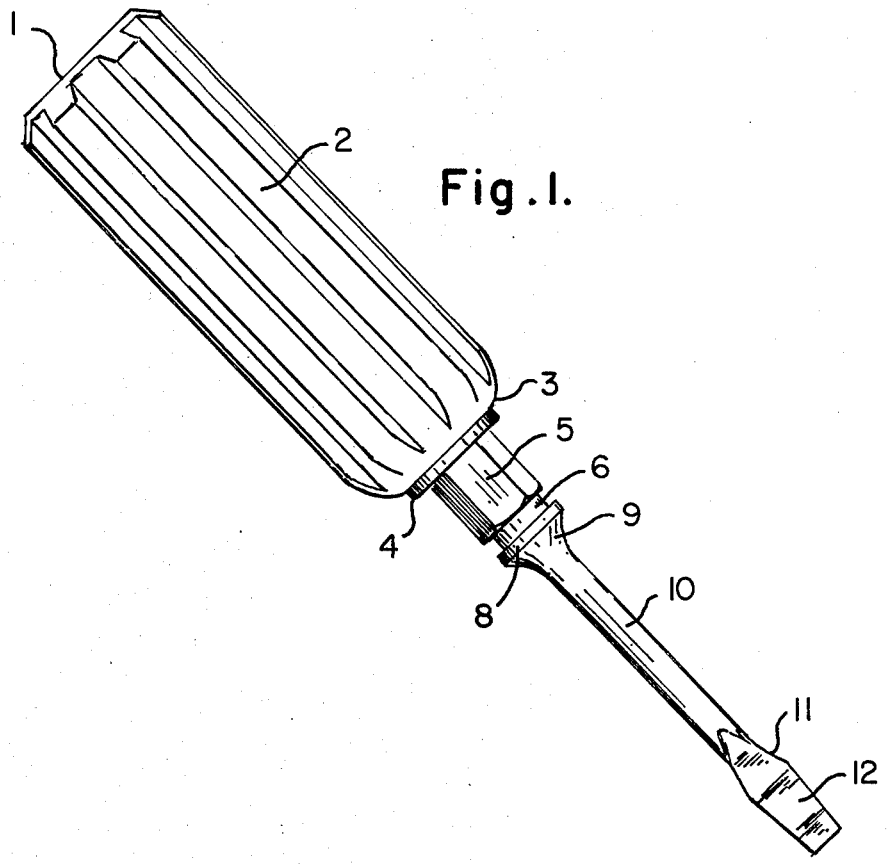
FIG. 1 is an isometric view of a screwdriver for use in this invention.

Referring to the drawings, I have illustrated a screwdriver having a handle 2 of conventional form with an end or top 1 against which pressure may be applied to hold it in contact with a screw head (not shown). The base 3 of handle 2 abuts the shoulder 4 of a receiver body 5 on the shank 10 of the screwdriver. The receiver body is preferably hexagonal in cross section, as shown particularly in FIG. 5, although it may be of any other regular multi-sided figure, e.g. a square or octagon. The receiver body is provided with an annular retainer clip groove 6 adjacent the end remote from the receiver shoulder and separated from a tapered receiver bottom 9 by an annular shoulder 8. The receiver bottom 9 tapers from shoulder 8 into shank 10. The end of shank 10 remote from the handle has the usual beam 11 and blade 12 which may be a conventional flat blade or a Phillips head blade as desired. A ratchet handle 22 is provided having a ratchet wheel 14 rotatably mounted in one end of a body 17 as in conventional ratchet wrenches. The ratchet wheel 14 is provided with a central female aperture or adapter 15 of the same configuration as receiver body 5 and is adapted to receive the same in sliding engagement. The ratchet wheel 14 is held in place by a cover plate 13 and screws 24 in usual manner and is provided with a reversible ratchet selector 16 on a selector shaft 27 carrying a ratchet dog assembly 28 in usual manner. A second cover plate 19 is provided on the opposite side, also held in place by screws 24. The second cover plate 19 is provided with a groove or slot 19*a* transverse to the female aperture 15 which slidably receives a retainer clip 20 which is normally urged toward aperture 15 by means of a spring 30 in a slot 31 lengthwise of retainer clip 20. The groove 19*a* is covered by a portion of cover plate 19 which is in effect a cover 33 for the retainer clip. One end of spring 30 bears against the end of slot 31 toward aperture 15 while the other end of spring 30 bears against guide pin and stop 32 which extends through second cover plate 19 into body 17 of the wrench. The clip 20 is movable from a lock position to a release position 21 (see FIG. 4) shown in dotted lines.

Figure 2:
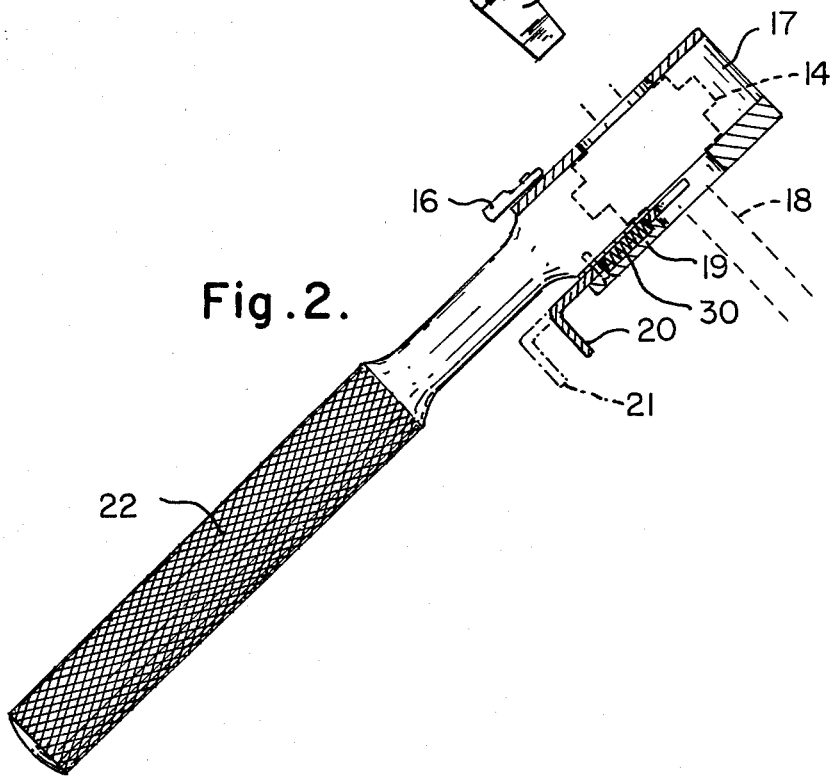
FIG. 2 is an isometric view of a ratchet handle for use in this invention in conjunction with the screwdriver of FIG. 1.

In operation the screwdriver shank 10 is inserted through the aperture 15 from the side of cover plate 13 opposite the retainer ring as shown in dotted lines 18 in FIG. 2. The tapered bottom 9 will force retainer clip 20 toward position 21 until the receiver body 5 is fully in aperture 15 with shoulder 4 abutting cover plate 13. At this point, the annular retainer clip groove 6 is aligned with retainer clip 20 and spring 30 forces clip 20 into groove 6 to hold the screw driver and ratchet handle together, all as shown in FIGS. 2 and 3. The unit is operated by inserting blade 12 into the slot in a screw, pushing down on handle top 1 while rotating handle 22 in the proper direction with the ratchet selector 16 set to give the proper drive and ratchet effect.

The screwdriver shank and handle are removed by pulling clip 20 into position 21 out of slot 6 simply withdrawing retainer body 5 from female aperture 15. When withdrawn, the screwdriver may be used just as any conventional screwdriver is used.

In the foregoing specification I have set out certain preferred embodiments of my invention, however, it will be understood that this invention may be otherwise embodied within the scope of the following claims.

I claim:

1. A ratcheting screwdriver comprising: an elongate shank, a handle at one end of said shank and integral therewith, a screwdriving blade at the opposite end of said shank and integral therewith, a regular multisided driven receiver body on said shank intermediate the handle and blade and integral therewith, stop means on the driven receiver body remote from said blade, an annular groove in said receiver body at the end thereof remote from the stop means, a tapering ramp means on the receiver body extending from said annular groove in the direction of said blade, an elongate handle having a ratchet wheel at one end with an opening of substantially the same size and shape as the receiver body and removably receiving said receiver body therein, reversible ratchet drive means between said handle and ratchet wheel, said receiver body and opening in the ratchet wheel having cross section greater than the largest blade to be used in said handle, and resilient clip means on said handle removably and rotatably engaging in said annular groove when the receiver body is fully engaged in said opening in the ratchet wheel.

2. A ratcheting screwdriver as claimed in claim 1 wherein the stop means is an annular shoulder on said receiver body.

3. A ratcheting screwdriver as claimed in claim 1 or 2 wherein the resilient clip means is a spring loaded flat plate having an arcuate head engaging said annular groove.

* * * * *